US008347907B2

(12) United States Patent
Pablo Curto et al.

(10) Patent No.: US 8,347,907 B2
(45) Date of Patent: Jan. 8, 2013

(54) ELECTRICAL CONNECTION DEVICE FOR A GAS CONTROL VALVE

(75) Inventors: Marcos Pablo Curto, Hernani (ES); Jon Ander Etxeberria Intxausti, Tolosa (ES); Ignacio Diez Martinez, Tolosa (ES)

(73) Assignee: Orkli, S. Coop, Ordizia (ES)

( * ) Notice: Subject to any disclaimer, the term of this patent is extended or adjusted under 35 U.S.C. 154(b) by 728 days.

(21) Appl. No.: 12/616,689

(22) Filed: Nov. 11, 2009

(65) Prior Publication Data

US 2010/0117014 A1 May 13, 2010

(30) Foreign Application Priority Data

Nov. 11, 2008 (ES) ..... 200802313 U

(51) Int. Cl.
*F23D 5/16* (2006.01)

(52) U.S. Cl. ..... 137/66; 251/129.15; 439/132; 439/135; 439/161; 439/184; 324/415; 200/51.1

(58) Field of Classification Search ..... 251/129.01, 251/129.15; 137/66; 439/312, 320, 132, 439/135, 161, 184; 324/415; 200/51.1; 361/142
See application file for complete search history.

(56) References Cited

U.S. PATENT DOCUMENTS 2,840,095 A * 6/1958 Thornbery ..... 137/66
3,286,216 A 11/1966 Jackson et al.
3,286,923 A 11/1966 Jackson et al.
3,467,893 A * 9/1969 Braucksiek et al. ..... 361/142
3,581,753 A * 6/1971 Ages ..... 137/66
3,654,591 A 4/1972 Jayaram et al.
3,810,054 A 5/1974 Nelson
6,182,944 B1 2/2001 Veronese et al.
6,604,540 B2 * 8/2003 Kuriyama et al. ..... 137/66
7,073,526 B2 7/2006 Nguyen
2006/0219285 A1 10/2006 Nguyen

* cited by examiner

*Primary Examiner* — John K Fristoe, Jr.
*Assistant Examiner* — Marina Tietjen
(74) *Attorney, Agent, or Firm* — Tim L. Kitchen; Peter B. Scull; Hamilton, DeSanctis & Cha, LLP

(57) ABSTRACT

An electrical connection device for a gas control valve. In one embodiment the device has a first electrical insulation member with an aperture extending between top and bottom surfaces and a second electrical insulation member having a top face and a bottom face and situated in the aperture of the first electrical insulation member so that the top face resides in the aperture and the bottom face resides outside the aperture. A joint member connects the first and second electrical insulation members. The device also includes first and second electrical terminals that are electrically insulated from one another and wherein each extends from the second electrical insulation member through the joint member to a location outside the first electrical insulation member. The first electrical terminal has a first inner terminal situated on the first face of the second electrical insulation member, a first outer terminal that projects out radially from the first insulation member, and a first intermediate segment that extends between the first inner terminal and the first outer terminal. The second electrical terminal has a second inner terminal situated on the second face of the second electrical insulation member, a second outer terminal that projects out radially from the first insulation member, and a second intermediate segment that extends between the second inner terminal and the second outer terminal.

29 Claims, 2 Drawing Sheets

ELECTRICAL CONNECTION DEVICE FOR A GAS CONTROL VALVE

CROSS-REFERENCE TO RELATED APPLICATIONS

This application claims priority to Spanish Patent Application No. U200802313, filed Nov. 11, 2008.

TECHNICAL FIELD

The present invention relates to an electrical connection device for a gas control valve of a gas heating appliance that includes a pilot flame.

BACKGROUND

There are known control valves adapted to gas heating appliances that include a pilot flame, such as water heaters, dryers, etc. The control valves comprise an electromagnetic safety valve that is housed in a body of the control valve and which closes the passage of gas in the event of the pilot flame being extinguished, and a thermocouple heated by a flame that generates an electrical current for operating the electromagnetic safety valve, keeping it energised while the pilot flame heats the flame thermocouple.

Such a control valve typically comprises an electrical switch as an additional safety element that acts on the electromagnetic safety valve when the water temperature in the gas heating appliance exceeds a certain temperature, cutting off at that point the supply of power to the safety valve. As the electromagnetic safety valve is not energised, it closes the passage of gas towards a burner of the heating appliance, regardless of whether the pilot flame remains lit.

In the prior art the use of electrical switches of the bimetallic type is known, these being switched off if a certain temperature is exceed.

In addition, during the last few years a control valve which comprises an electrical switch of the butterfly type has been used which presents, among other drawbacks, problems with regard to the stiffness of the connections as well as assembly problems. In these types of control valves the electromagnetic safety valve is fixed by being threaded into the interior of a body of the control valve, with a subsequent reduction of both manufacturing and assembly costs.

For the purposes of solving the problems of control valves with a butterfly-type electrical switch, U.S. Pat. No. 7,073,526 B2 discloses a gas control valve that comprises a valve or electromagnetic unit, a spacer, a retention member that is threaded onto the body of the control valve to hold the electromagnetic valve and the spacer in the interior of the body, and a connector designed to be coupled to the spacer from the exterior of the control valve once the electromagnetic valve, the spacer and the retention member have been assembled on the control valve.

Finally, U.S. Pat. No. 3,654,591 describes a gas control valve that comprises an electromagnetic valve, an electrical switch that comes into contact with the electromagnetic valve, a thermocouple, and a retention member that holds the electromagnetic valve and electrical switch in the interior of the body of the control valve. The electrical switch comprises a substantially cylindrical insulating body and electrical connection terminals for the electrical connection to the electromagnetic valve and the thermocouple, where flexible electrical cables are respectively fixed.

SUMMARY OF THE DISCLOSURE

An object of the present invention is to provide an electrical connection device adapted to a gas control valve as disclosed herein and as recited in the appended claims.

In accordance with one embodiment, a gas control valve is provided that comprises a valve body, an electromagnetic valve that is housed in the interior of the valve body and an electrical connection device. The electromagnetic valve includes a sealing member configured to seat against the valve body to provide a gas tight seal. The electromagnetic valve adapted to be powered by a thermocouple via the electrical connection device.

In one embodiment the electrical connection device comprises an insulating member, a first electrical terminal that is connected to the electromagnetic valve, and a second electrical terminal that is connected to the thermocouple, the first electrical terminal and the second electrical terminal being fixed to a base of the insulating member. The insulating member of the connection device also includes a seating member that is configured to rest against the sealing member of the electromagnetic valve in a manner that causes the sealing member to be pressed tightly against the valve body. The base and the seating member of the insulating member are independent to each other and connected by means of a flexible joint member.

An advantage of the present invention is that it provides a compact and simple electrical connection device that is adapted to press against the sealing member of the electromagnetic valve in a manner that prevents unwanted gas to be leaked from the valve body, and also ensures, at all times, a good electrical connection between the electrical connection device and the electromagnetic valve and thermocouple. In addition, the joint member connecting the seating member and base of the insulating member acts to absorb the manufacturing and/or assembly tolerances that exist between the sealing interface of the valve body made by the sealing member and a connection terminal of the electromagnetic valve.

These and other advantages and characteristics of the invention will be made evident in the light of the drawings and the detailed description thereof.

BRIEF DESCRIPTION OF THE DRAWINGS

Other advantages and features of the invention can be seen in the following description in which, with a non-limiting character, preferred embodiments of the invention are referred to in relation to the attached drawings. In the figures.

DETAILED DESCRIPTION

Figure 1:
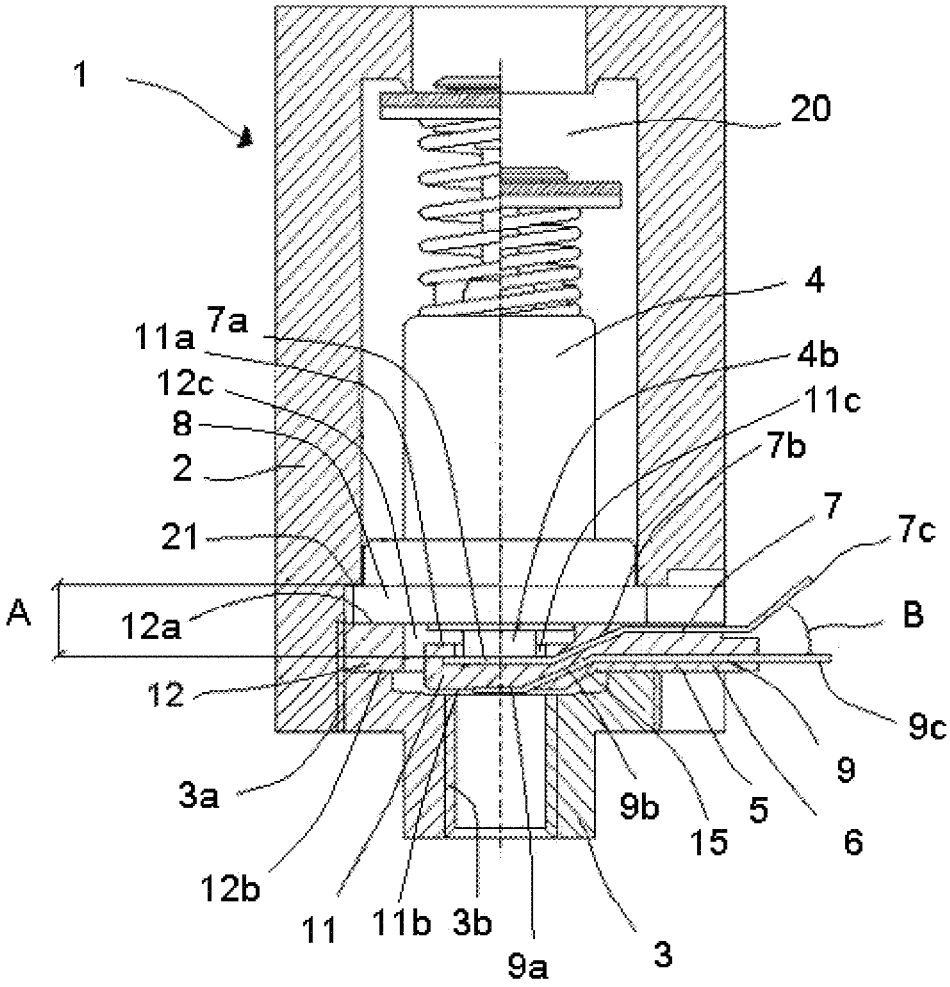
FIG. 1 is a partial cross-section of a gas control valve that comprises an electrical connection device according to one embodiment of the present invention.

With reference to FIG. 1, a gas control valve in one embodiment of the present invention is shown. In one implementation, the gas control valve 1 is adapted for use with a gas water-heating appliance that includes a pilot flame, with the control valve 1 comprising a valve body 2 that includes a substantially cylindrical housing 20, an electromagnetic valve 4 that is housed in the interior of the housing 20 and which includes a sealing member 8 that closes against an inner edge 21 of the housing 20. A thermocouple, not shown in the figures, is electrically coupled to the electromagnetic valve 4 to provide power to energize and keep the electromagnetic valve open, as depicted on the right-hand side of FIG. 1, to enable the passage of gas towards a burner (not shown) of a gas heating appliance while a pilot flame heats the thermocouple. The control valve 1 also includes an electrical connection device 5 connected to the electromagnetic valve 4 and the thermocouple. In accordance with one embodiment, when the water temperature in the gas appliance exceeds a certain preset temperature, power to the electromagnetic valve 4 through the electrical connection device 5 is terminated to cause the control valve to close (as depicted on the left-hand side of FIG. 1) to close the passage of gas towards the burner, regardless of whether the pilot flame remains lit.

The control valve 1 also comprises a retention member 3 that is fixed to the interior of the valve body 2 by a exterior thread 3*a*, once the electromagnetic valve 4 and the electrical connection device 5 have been inserted axially into the interior of the housing 20, thereby holding the electromagnetic valve 4 and the electrical connection device 5 in place. The retention member 3 also includes an inner thread 3*b* in which the terminals of the thermocouple may be fixed.

The construction of electromagnetic valves is known in the art. As such, the details of the electromagnetic valve 4 have not been included in the description herein.

Figure 2:
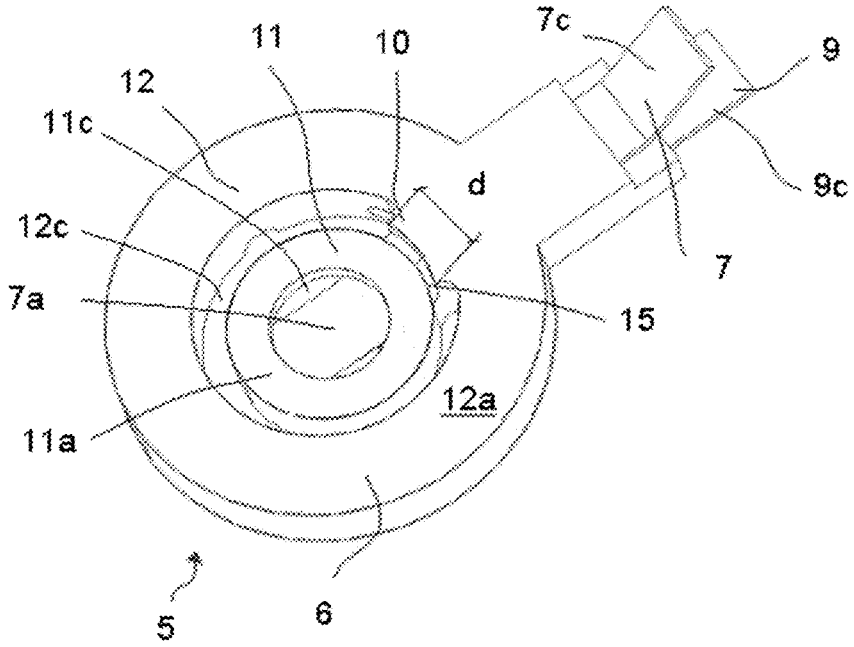
FIG. 2 is a view in perspective of the electrical connection device shown in FIG. 1.
Figure 3:
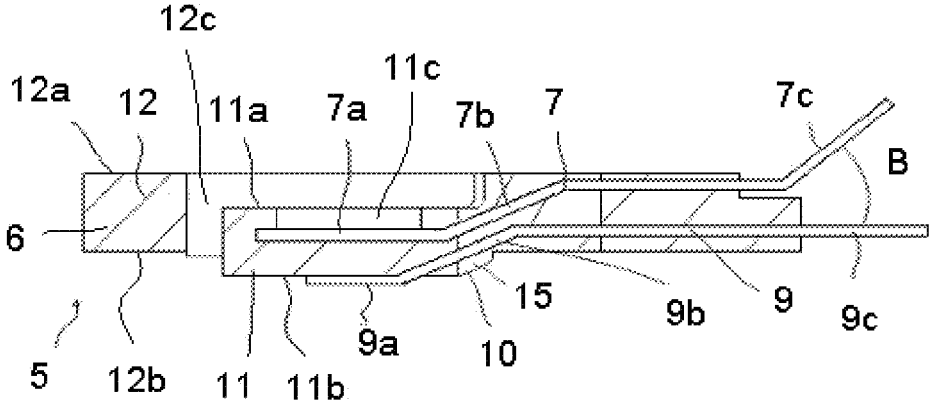
FIG. 3 is a side view of the electrical connection device shown in FIG. 1.

The electrical connection device 5, shown in detail in FIGS. 2 and 3, comprises an insulating member 6, a first electrical terminal 7 that is connected to a connection terminal 4*b* of the electromagnetic valve 4, and a second electrical terminal 9 that is connected to a terminal of the thermocouple, with the first electrical terminal 7 and the second electrical terminal 9 being disposed on or otherwise fixed to the insulating member 6.

The insulating member 6 is preferably made of a plastic/elastomeric material and comprises a first electrical insulation member/seating member 12 that has a top surface/support surface 12*a* that preferably presses uniformly against the sealing member 8 of the electromagnetic valve 4, a bottom surface 12*b*, and an aperture 12*c* extending between the top surface 12*a* and bottom surface 12*b*. The insulating member 6 further comprises a second electrical insulation member/base 11 having a first face 11*a* and a second face 11*b*, the second electrical insulation member 11 being situated in the aperture 12*c* of the first electrical insulation member 12 so that first face 11*a* resides within the aperture 12*c* and the second face 11*b* resides outside the aperture 12 below the bottom surface 12*b* of the first electrical insulation member 12. The first and second electrical insulation members are connected by means of a flexible or otherwise deformable joint member 10 that permits the first and second electrical insulation members to be moved relative to one another. As shown in FIGS. 1 to 3, the first face 11*a* may reside within a recess 11 of the second electrical insulation member 11. In a preferred implementation, the top surface 12*a* and the bottom surface 12*b* of the first electrical insulation member 12, and the first face 11*a* and the second face 11*b* of the second electrical insulation member 11 are substantially flat, and disposed substantially parallel to one another. In alternative implementations, the first and/or second electrical insulation members 11 and 12 comprise a multi-layered construction with the first and/or second electrical terminals being electrically insulated from one another by at least one of the layers. In other implementations, the first electrical insulation member 12 may comprise a top surface insulation layer and a bottom surface insulation layer (not shown) that electrically isolate electrical terminals 7 and 9, respectively, from other gas valve components. In yet other implementations, one or both of the electrical terminals 7 and 9 may reside on the top and bottom surfaces 12*a* and 12*b* of member 12, respectively, with their exposed surfaces being coated with an electrical insulation material.

Preferably, the connection device 5 uniformly presses against sealing member 8 so that the sealing member 8 closes hermetically against the valve body 2, particularly against the inner edge 21, thereby preventing, when the electromagnetic valve 4 is energised, the leaking of gas to the exterior of the valve body 2, and also ensuring, at all times, a good connection between the first electrical terminal 7 and the connection terminal 4*b* of the electromagnetic valve 4. Due to the manufacturing and/or assembly tolerances of the different pieces that comprise the control valve 1, the distance A shown in FIG. 1, between the closure of the sealing member 8 against the valve body 2 and the connection terminal 4*b*, is variable with the joint member 10 absorbing the variations produced by said tolerances.

In one implementation, the second electrical insulation member/base 11 and the first electrical insulation member/seating member 12 have a substantially circular shape and are disposed concentric to each other, and are radially connected to each other by means of the joint member 10. In the embodiment of FIGS. 1 to 3, the joint member 10 comprises at least one rib 15, with a width "d" of said rib 15 being less than half the perimeter of the second electrical insulation member/base 11. In a preferred embodiment, the width "d" is less than a quarter of the perimeter of the second electrical insulation member/base 11. In other embodiments, the width "d" is less than half of the diameter of the second electrical insulation member/base 11 or preferably, less than a quarter of the diameter of the second electrical insulation member/base 11.

As shown in the embodiment of FIGS. 1 to 3, the first electrical terminal 7 comprises a first inner contact terminal 7*a* that rests on or is otherwise fixed onto the first face 11*a* of the second electrical insulation member/base 11 and comes into contact with the connection terminal 4*b* of the electromagnetic valve 4. Electrical terminal 7 includes a first intermediate segment 7*b* that passes through the rib 15, and a first outer terminal 7*c* that projects out radially in relation to the insulating member 6, with the first inner terminal 7*a*, the first intermediate segment 7*b* and the first outer terminal 7*c* being continuous to each other.

Further, the second electrical terminal 9 comprises a second inner contact terminal 9*a* that rests on or is otherwise fixed onto the second face 11*b* of the second electrical insulation member/base 11 and comes into contact with the terminal of the thermocouple in retention member 3 (not shown). The second electrical terminal 9 includes a second intermediate segment 9*b* that passes through the rib 15, and a second outer terminal 9*c* that projects out radially in relation to the insulating member 6, with the second inner terminal 9*a*, the second intermediate segment 9*b* and the second outer terminal 9*c* being continuous to each other.

In alternative implementations, one or both of the intermediate segments 7*b* and 9*b* of the first and second electrical terminals 7 and 9, respectively, reside on an external surface of the flexible joint 10, rather than passing through it.

The first electrical terminal 7 and the second electrical terminal 9 are insulated from each other by means of the insulating member 6. The first outer terminal 7*c* forms an angle B, preferably of 45° in relation to the second outer terminal 9*c*. In addition, in one embodiment, both the first outer terminal 7*c* and the second outer terminal 9*c* have a flat geometry and are fast connection terminals.

What is claimed is:

1. An electrical connection device comprising:

a first electrical insulation member having a top surface, a bottom surface and an aperture extending between the top surface and the bottom surface;

a second electrical insulation member having a first face and a second face and situated in the aperture of the first electrical insulation member so that the first face resides in the aperture and the second face resides outside the aperture below the bottom surface of the first electrical insulation member;

at least one joint member connecting the first and second electrical insulation members;

a first electrical terminal extending from the second electrical insulation member via the joint member to a location outside the first electrical insulation member, the first electrical terminal having a first inner terminal situated on the first face of the second electrical insulation member, a first outer terminal that projects out radially from the first electrical insulation member and a first intermediate segment extending between the first inner terminal and the first outer terminal; and a second electrical terminal extending from the second electrical insulation member via the joint member to a location outside the first electrical insulation member, the second electrical terminal having a second inner terminal situated on the second face of the second electrical insulation member, a second outer terminal that projects out radially from the first electrical insulation member and a second intermediate segment extending between the second inner terminal and the second outer terminal.

2. An electrical connection device according to claim 1, wherein the at least one joint member is a flexible joint member.

3. An electrical connection device according to claim 1, wherein the first electrical terminal extends from the second electrical insulation member through the joint member and the first electrical insulation member to a location outside the first electrical insulation member.

4. An electrical connection device according to claim 1, wherein the second electrical terminal extends from the second electrical insulation member through the joint member and the first electrical insulation member to a location outside the first electrical insulation member.

5. An electrical connection device according to claim 1, wherein the first electrical terminal extends from the second electrical insulation member through the joint member and the first electrical insulation member to a location outside the first electrical insulation member and the second electrical terminal extends from the second electrical insulation member through the joint member and the first electrical insulation member to a location outside the first electrical insulation member.

6. An electrical connection device according to claim 1, wherein the first face of the second electrical insulation member resides within a recess of the second electrical insulation member.

7. An electrical connection device according to claim 2 comprising only one flexible joint member, wherein the second electrical insulation member has perimeter dimension, the width of the flexible joint member being less than half the perimeter dimension.

8. An electrical connection device according to claim 2 comprising only one flexible joint member, wherein the second electrical insulation member has perimeter dimension, the width of the flexible joint member being less than a quarter of the perimeter dimension.

9. An electrical connection device according to claim 2 comprising only one flexible joint member, wherein the second electrical insulation member has a substantially circular shape having a diameter, the width of the flexible joint member being less than half the diameter.

10. An electrical connection device according to claim 2 comprising only one flexible joint member, wherein the second electrical insulation member has a substantially circular shape having a diameter, the width of the flexible joint member being less than a quarter of the diameter.

11. An electrical connection device according to claim 1, wherein the first and second electrical insulation members each have a substantially circular shape and are disposed substantially concentric to one another.

12. An electrical connection device according to claim 1, wherein the top and bottom surfaces of the first electrical insulation member and the first and second faces of the second electrical insulation member are substantially flat.

13. An electrical connection device according to claim 12, wherein the top surface, the bottom surface, the first face and the second face are disposed substantially parallel to one another.

14. An electrical connection device according to claim 1, wherein the first electrical terminal and the second electrical terminal each have a flat geometry.

15. An electrical connection device according to claim 1, wherein the first outer terminal and the second outer terminal are fast connection terminals.

16. An electrical connection device according to claim 1, wherein the first outer terminal forms an angle in relation to the second outer terminal.

17. An electrical connection device comprising:

a first electrical insulation member having a top surface, a bottom surface and an aperture extending between the top surface and the bottom surface;

a second electrical insulation member having a first face and a second face and situated in the aperture of the first electrical insulation member so that the first face resides in the aperture and the second face resides outside the aperture below the bottom surface of the first electrical insulation member;

at least one flexible joint member connecting the first and second electrical insulation members;

a first electrical terminal extending from the second electrical insulation member through the flexible joint member to a location outside the first electrical insulation member, the first electrical terminal having a first inner terminal situated on the first face of the second electrical insulation member, a first outer terminal that projects out radially from the first electrical insulation member and a first intermediate segment extending between the first inner terminal and the first outer terminal; and a second electrical terminal extending from the second electrical insulation member through the flexible joint member to a location outside the first electrical insulation member, the second electrical terminal having a second inner terminal situated on the second face of the second electrical insulation member, a second outer terminal that projects out radially from the first electrical insulation member and a second intermediate segment extending between the second inner terminal and the second outer terminal;

the first electrical terminal extending from the second electrical insulation member through the flexible joint member and the first electrical insulation member to a location outside the first electrical insulation member and the second electrical terminal extending from the second electrical insulation member through the flexible joint member and the first electrical insulation member to a location outside the first electrical insulation member;

each of the first and second electrical insulation members having a substantially circular shape and being disposed substantially concentric to one another;

the top surface, the bottom surface, the first face and the second face being substantially flat and disposed substantially parallel to one another.

18. A gas control valve comprising:

a valve body having an interior cavity, an electromagnetic valve located within the interior cavity of the valve body and having a sealing member that sits against the valve body to provide a gas tight seal, the electromagnetic valve configured to be powered by a thermocouple;

an electrical connection device comprising:

a first electrical insulation member having a top surface, a bottom surface and an aperture extending between the top surface and the bottom surface, the top surface pressed tightly against the sealing member of the electromagnetic valve;

a second electrical insulation member having a first face and a second face and situated in the aperture of the first electrical insulation member so that the first face resides in the aperture and the second face resides outside the aperture below the bottom surface of the first electrical insulation member;

at least one joint member connecting the first and second electrical insulation members;

a first electrical terminal extending from the second electrical insulation member via the joint member to a location outside the first electrical insulation member, the first electrical terminal having a first inner terminal situated on the first face of the second electrical insulation member, a first outer terminal that projects out radially from the first electrical insulation member and a first intermediate segment extending between the first inner terminal and the first outer terminal, the first inner terminal electrically connected to the electromagnetic valve; and a second electrical terminal extending from the second electrical insulation member via the joint member to a location outside the first electrical insulation member, the second electrical terminal having a second inner terminal situated on the second face of the second electrical insulation member, a second outer terminal that projects out radially from the first electrical insulation member and a second intermediate segment extending between the second inner terminal and the second outer terminal, the second inner terminal configured to be electrically coupled to the thermocouple.

19. A gas control valve according to claim 18, wherein the at least one joint member is a flexible joint member.

20. A gas control valve according to claim 18, wherein the first electrical terminal extends from the second electrical insulation member through the joint member and the first electrical insulation member to a location outside the first electrical insulation member and the second electrical terminal extends from the second electrical insulation member through the joint member and the first electrical insulation member to a location outside the first electrical insulation member.

21. A gas control valve according to claim 18, wherein the first face of the second electrical insulation member resides within a recess of the second electrical insulation member.

22. A gas control valve according to claim 19 comprising only one flexible joint member, wherein the second electrical insulation member has perimeter dimension, the width of the flexible joint member being less than half the perimeter dimension.

23. A gas control valve according to claim 19 comprising only one flexible joint member, wherein the second electrical insulation member has perimeter dimension, the width of the flexible joint member being less than a quarter of the perimeter dimension.

24. A gas control valve according to claim 19 comprising only one flexible joint member, wherein the second electrical insulation member has a substantially circular shape having a diameter, the width of the flexible joint member being less than half the diameter.

25. A gas control valve according to claim 19 comprising only one flexible joint member, wherein the second electrical insulation member has a substantially circular shape having a diameter, the width of the flexible joint member being less than a quarter of the diameter.

26. A gas control valve according to claim 18, wherein the first and second electrical insulation members each have a substantially circular shape and are disposed substantially concentric to one another.

27. A gas control valve according to claim 18, wherein the top and bottom surfaces of the first electrical insulation member and the first and second faces of the second electrical insulation member are substantially flat.

28. A gas control valve according to claim 27, wherein the top surface, the bottom surface, the first face and the second face are disposed substantially parallel to one another.

29. A gas control valve comprising:

a valve body having an interior cavity, an electromagnetic valve located within the interior cavity of the valve body and having a sealing member that sits against the valve body to provide a gas tight seal, the electromagnetic valve configured to be powered by a thermocouple;

an electrical connection device comprising:

a first electrical insulation member having a top surface, a bottom surface and an aperture extending between the top surface and the bottom surface, the top surface pressed tightly against the sealing member of the electromagnetic valve;

a second electrical insulation member having a top face and a bottom face and situated in the aperture of the first electrical insulation member so that the top face resides in the aperture and the bottom face resides outside the aperture;

at least one flexible joint member connecting the first and second electrical insulation members;

a first electrical terminal extending from the second electrical insulation member through the flexible joint member to a location outside the first electrical insulation member, the first electrical terminal having a first inner terminal situated on the first face of the second electrical insulation member, a first outer terminal that projects out radially from the first electrical insulation member and a first intermediate segment extending between the first inner terminal and the first outer terminal, the first inner terminal electrically connected to the electromagnetic valve; and a second electrical terminal extending from the second electrical insulation member through the flexible joint member to a location outside the first electrical insulation member, the second electrical terminal having a second inner terminal situated on the second face of the second electrical insulation member, a second outer terminal that projects out radially from the first electrical insulation member and a second intermediate segment extending between the second inner terminal and the second outer terminal, the second inner terminal configured to be electrically coupled to the thermocouple;

the first electrical terminal extending from the second electrical insulation member through the flexible joint member and the first electrical insulation member to a location outside the first electrical insulation member and the second electrical terminal extending from the second electrical insulation member through the flexible joint member and the first electrical insulation member to a location outside the first electrical insulation member;

each of the first and second electrical insulation members having a substantially circular shape and being disposed concentric to one another;

the top surface, the bottom surface, the first face and the second face being substantially flat and disposed substantially parallel to one another.

* * * * *